United States Patent [19]

Materniak nee Babcerowicz et al.

[11] 4,081,915

[45] Apr. 4, 1978

[54] EXHAUST SYSTEM FOR LAUNDRY DRYER

[76] Inventors: Gizela Materniak née Babcerowicz; Zdzislaw Materniak, both of 7211 Fielding Avenue, Apt. 102, Montreal, Canada

[21] Appl. No.: 692,686

[22] Filed: Jun. 4, 1976

[51] Int. Cl.[2] ..... F24F 13/18

[52] U.S. Cl. ..... 34/235; 98/99.1; 98/119

[58] Field of Search ..... 98/99 R, 62, 99.1, 116, 98/DIG. 7, 119, 89, 99.7, 94 AC; 34/235; 62/262; 285/9 M, 402, 401; 160/214, 223, 225

[56] References Cited

U.S. PATENT DOCUMENTS

| | | | |
|---|---|---|---|
| 852,650 | 5/1907 | Cannon | 98/99 R |
| 1,031,456 | 7/1912 | Leslie | 98/99 R |
| 1,120,361 | 12/1914 | Bauer | 98/99 R |
| 1,732,870 | 10/1929 | Weaver | 98/99.1 |
| 1,924,284 | 8/1933 | Kohler | 98/99.1 |
| 2,047,714 | 7/1936 | Smith, Sr. | 285/402 |
| 3,280,896 | 10/1966 | Goodson et al. | 285/9 M |
| 3,285,155 | 11/1966 | Maltenfort | 98/119 |
| 3,431,966 | 3/1969 | Injeski | 160/225 |
| 3,842,722 | 10/1974 | Miller | 98/119 |
| 3,959,892 | 6/1976 | Cloud et al. | 34/235 |

FOREIGN PATENT DOCUMENTS

| | | | |
|---|---|---|---|
| 1,466,542 | 1/1967 | France | 285/9 M |

*Primary Examiner*—John J. Camby
*Assistant Examiner*—Henry C. Yuen

[57] ABSTRACT

An exhaust system for home appliances requiring outside venting, such as a portable laundry dryer, which obviates the necessity of piercing an exterior wall to vent the appliance to the outside. The system includes a transparent window insert plate assembly, removably insertable within a window opening and having an exhaust outlet and a flexible air hose having means at both ends to removably connect the same with the air outlet of a laundry dryer and with the exhaust outlet of the window insert plate assembly. The latter outlet has closure means to seal the window opening when the dryer is not in use. This closure means can be automatically closable, or manually closable. In the latter case, it can be arranged so that no part will protrude from the outside of the window in the closed position.

5 Claims, 36 Drawing Figures

11
9
14
10
11

11
5
4
29
17
16
9
15
18
14
10
11
5
4
1

13
10
13

12
9
12

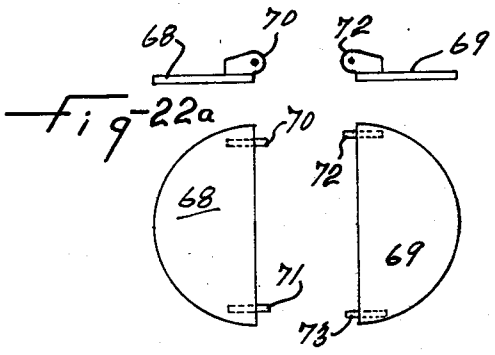
Fig-22a
Fig-22
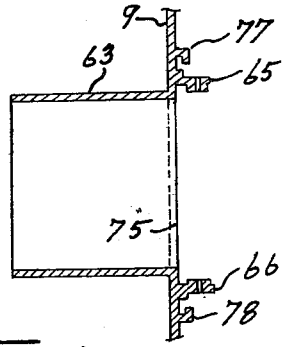
Fig-21
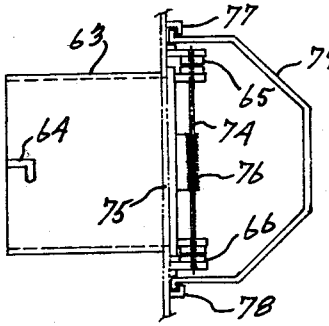
Fig-20
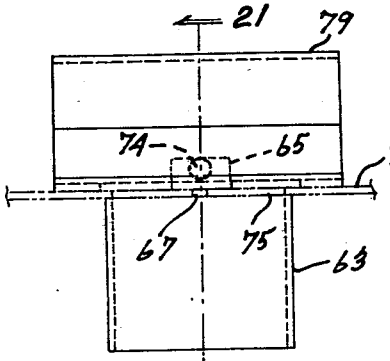
Fig-18
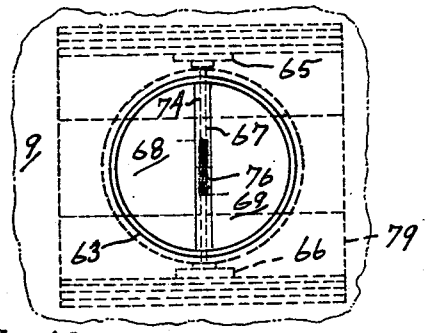
Fig-19

107
104
102
104

102
109
105
108
103

108
109
109
102
105

108
105

107
104
106
107
36
35
36
109
102
109
35
34
103
108
34

EXHAUST SYSTEM FOR LAUNDRY DRYER

The present invention relates to an exhaust system for a laundry dryer. Conventional exhaust systems of the type described require piercing an outside wall and providing an outside vent connected to the dryer by means of a flexible hose. However, in a plurality of buildings, especially where the premises are rented, it is forbidden to make alterations to the walls of the building and/or to modify the window frames, and yet there is no provision for discharging the flow of the hot and humid air from a dryer to the outside. Therefore, the occupants cannot avail themselves of the advantages of a laundry dryer.

The object of the invention is to provide an exhaust system of the type described, which is designed to obviate the above-noted disadvantage in that it makes use of any window opening to serve as an outlet for the dryer exhaust air, while at the same time preventing cold air from entering the premises, especially during wintertime.

Another object of the invention resides in the provision of a system of the character described in which a window insert plate assembly fits within a window opening and makes sealing contact herewith, said assembly being provided with an exhaust outlet and with means to connect a flexible hose to said outlet. The exhaust outlet is provided with closure means to prevent entry of outside air when the dryer is not in use.

In accordance with another object of the invention, the closure means are automatically operable to close the opening whenever the dryer is stopped, or when the hose is disconnected.

In another object of the invention, the closure means are manually operated between an open positioning extending externally from the plate insert and a closed position flush with the same, so as not to constitute any unsightly projection at the exterior of the window.

In accordance with another object of the invention, an insert is also provided to fit the interior window of a double window unit.

In accordance with yet another object of the invention, a quick disconnect coupling means is provided between the hose and the laundry dryer and such as to fit the exhaust tube of practically any type of laundry dryer.

In accordance with another object of the invention, the window plate inserts are adjustable in length to fit various widths of window openings.

The foregoing and other objects of the present invention will become more apparent during the following disclosure and by referring to the drawings, in which.

Figures 2, 3, 4, 5:
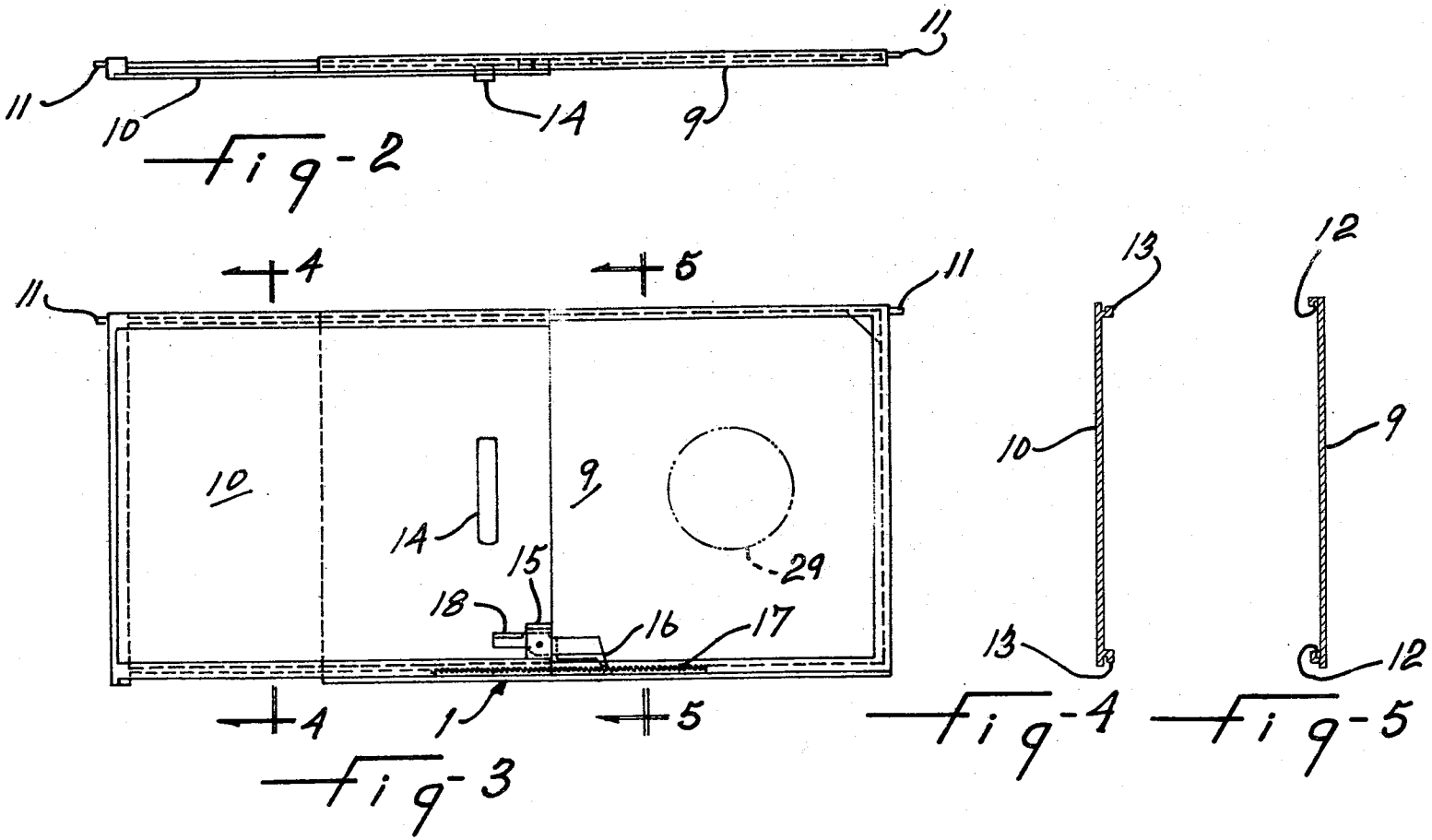
FIG. 2 is a top plan view of the exterior insert plate assembly.
FIG. 3 is an elevation of the assembly of FIG. 2.
Figure 6:
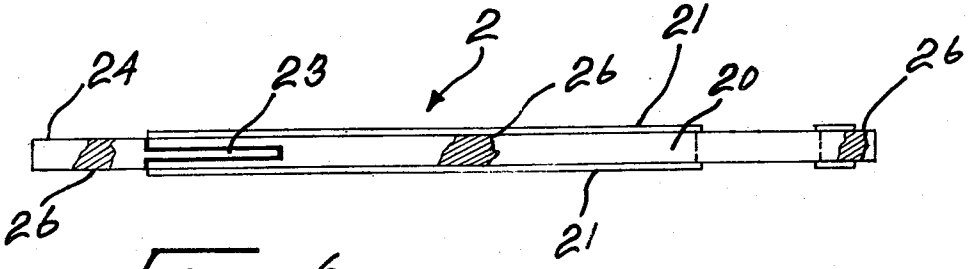
Figure 7:
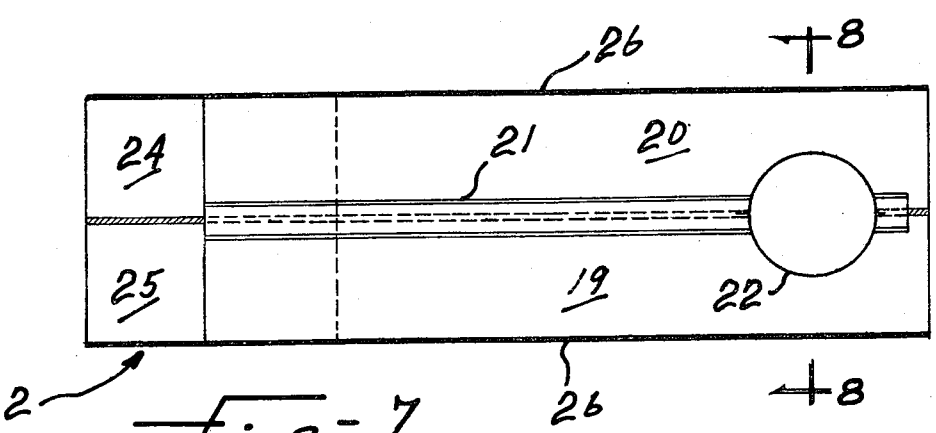
Figure 8:
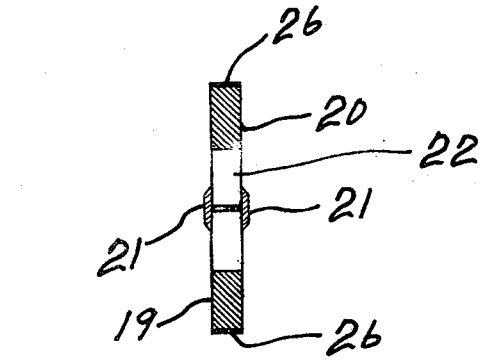
Figures 9, 10, 11, 12, 13, 25:
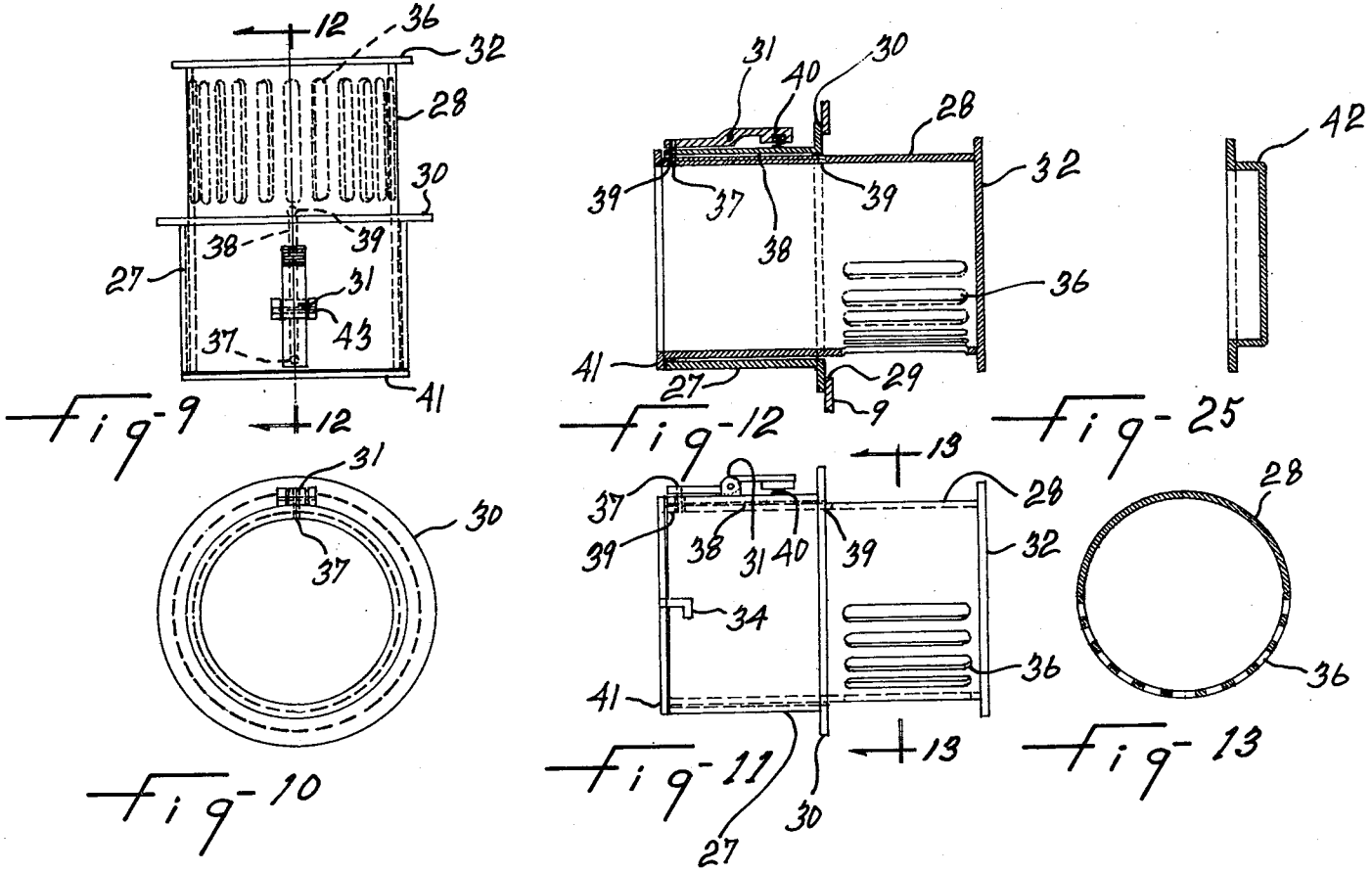
Figure 15:
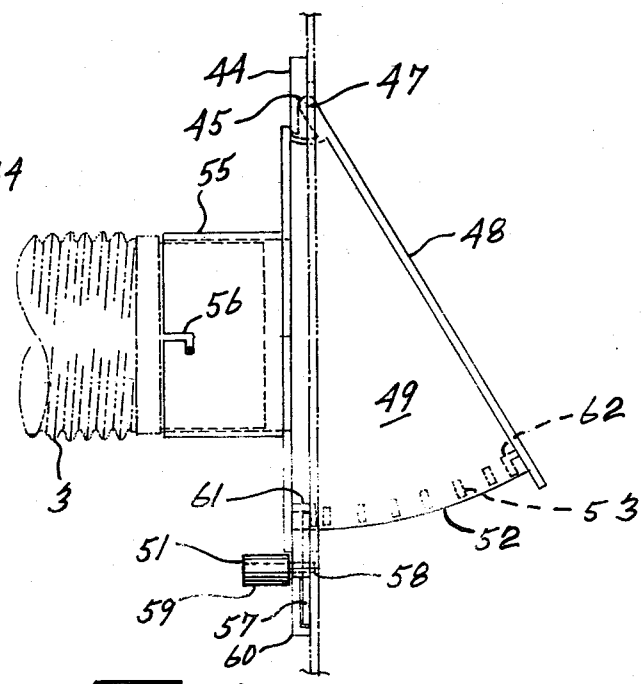
Figure 14:
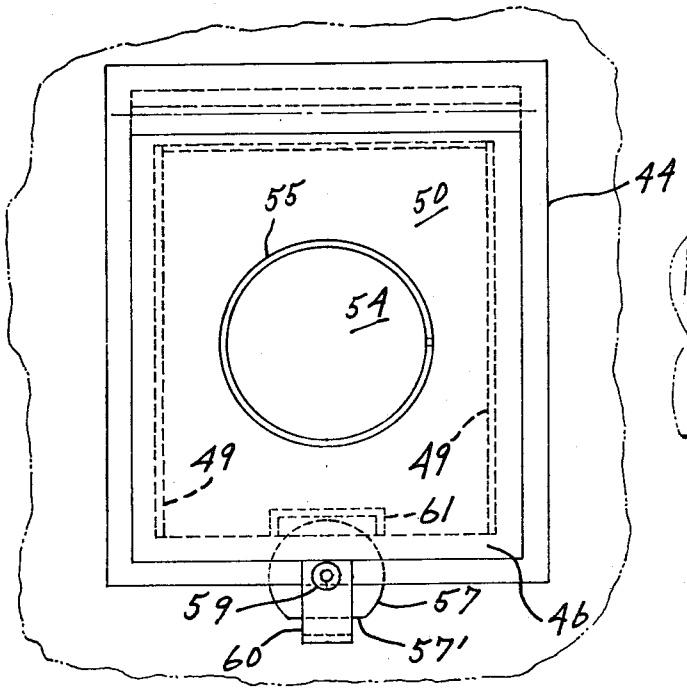
Figure 17:
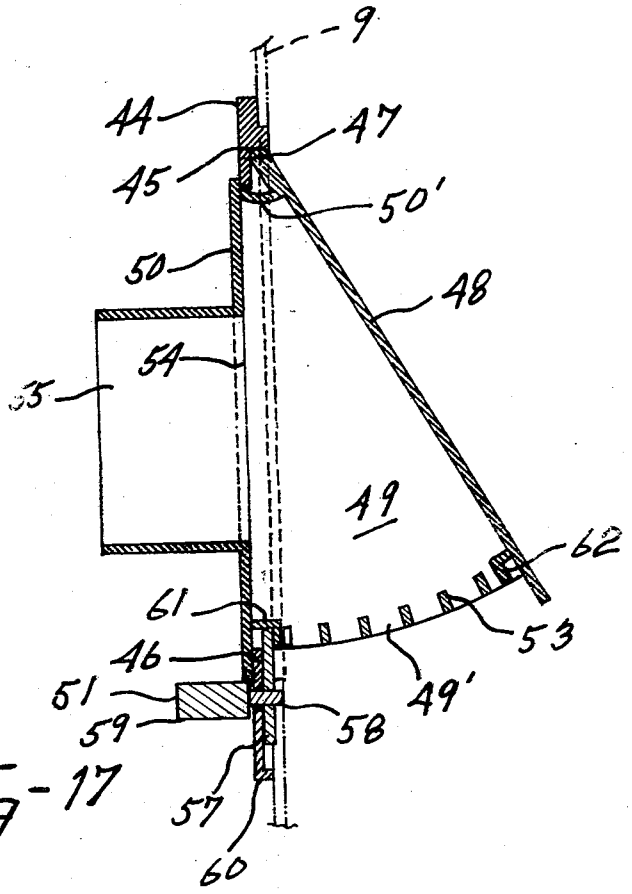
Figure 16:
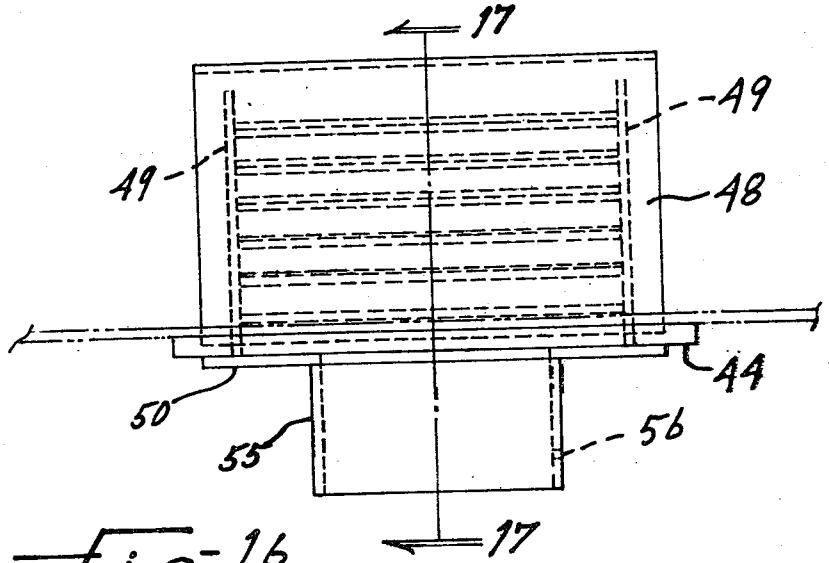
Figure 23:
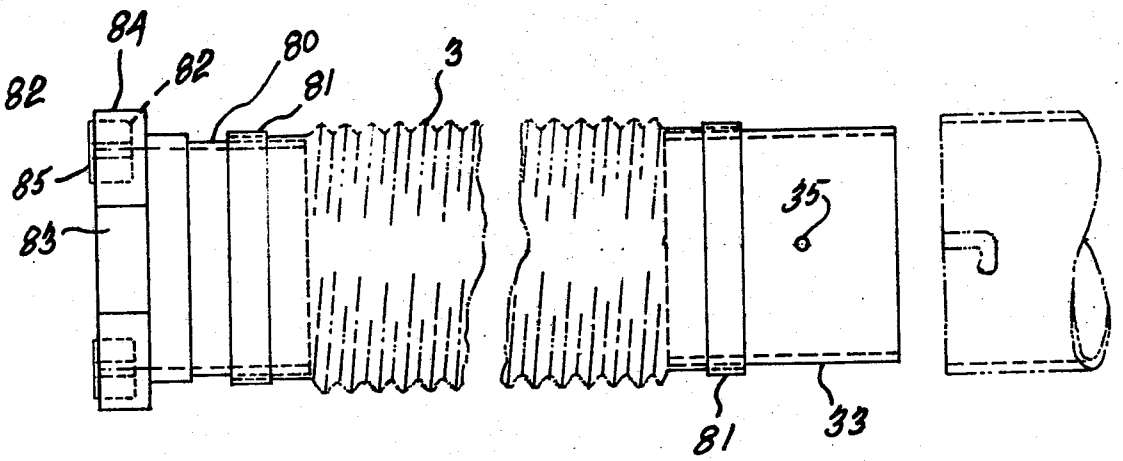
Figure 24:
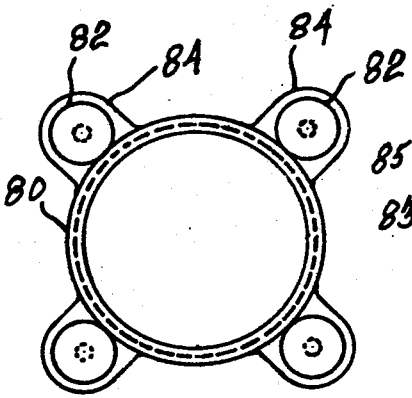
Figures 26, 27, 28:
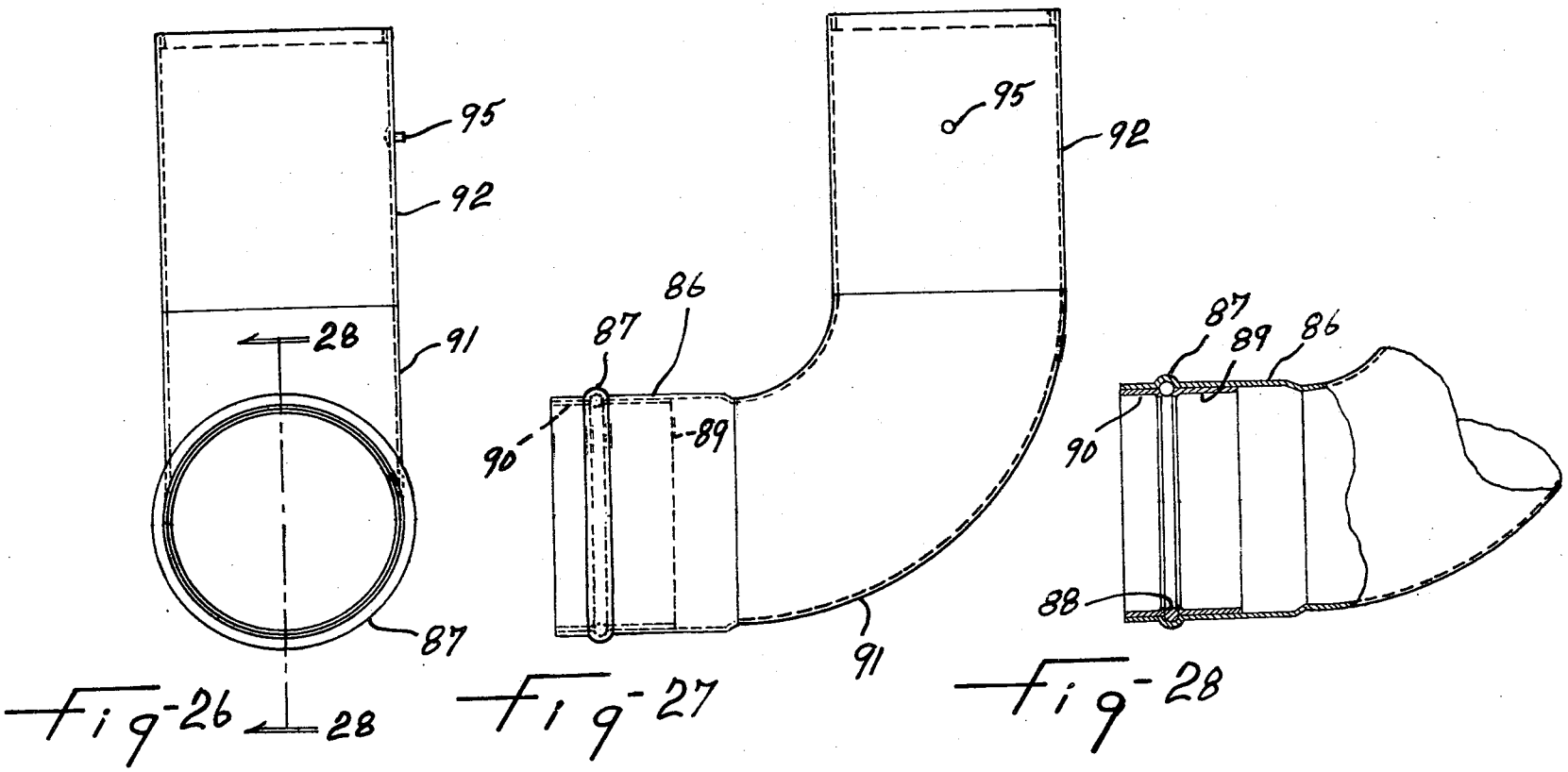
Figure 30:
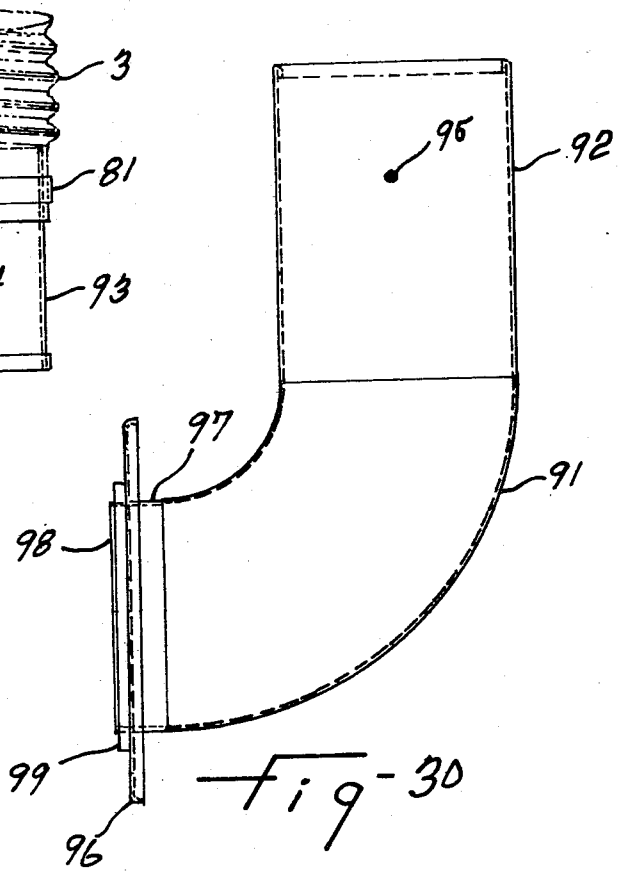
Figure 31:
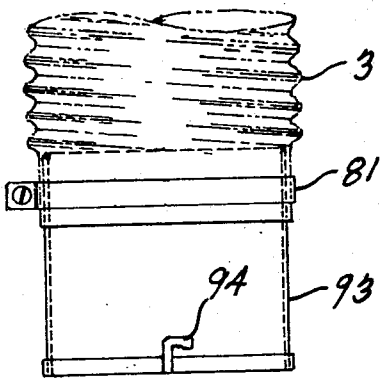
Figure 29:
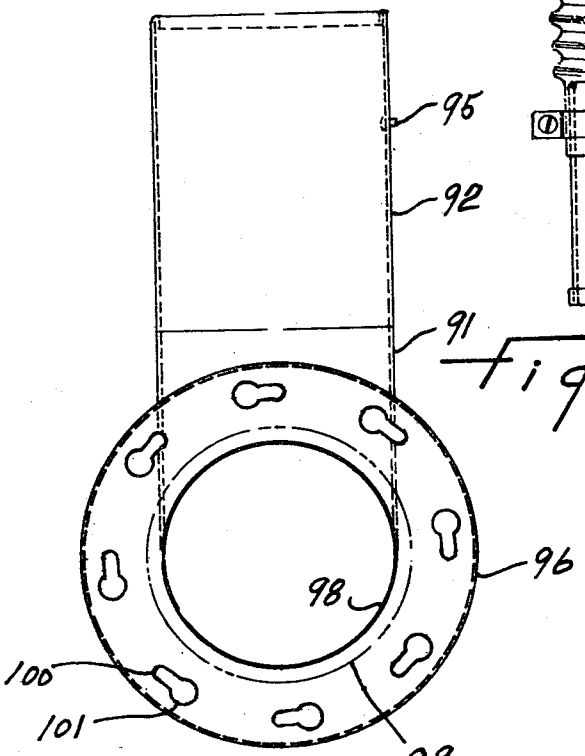
Figures 32, 33, 34, 35, 36:
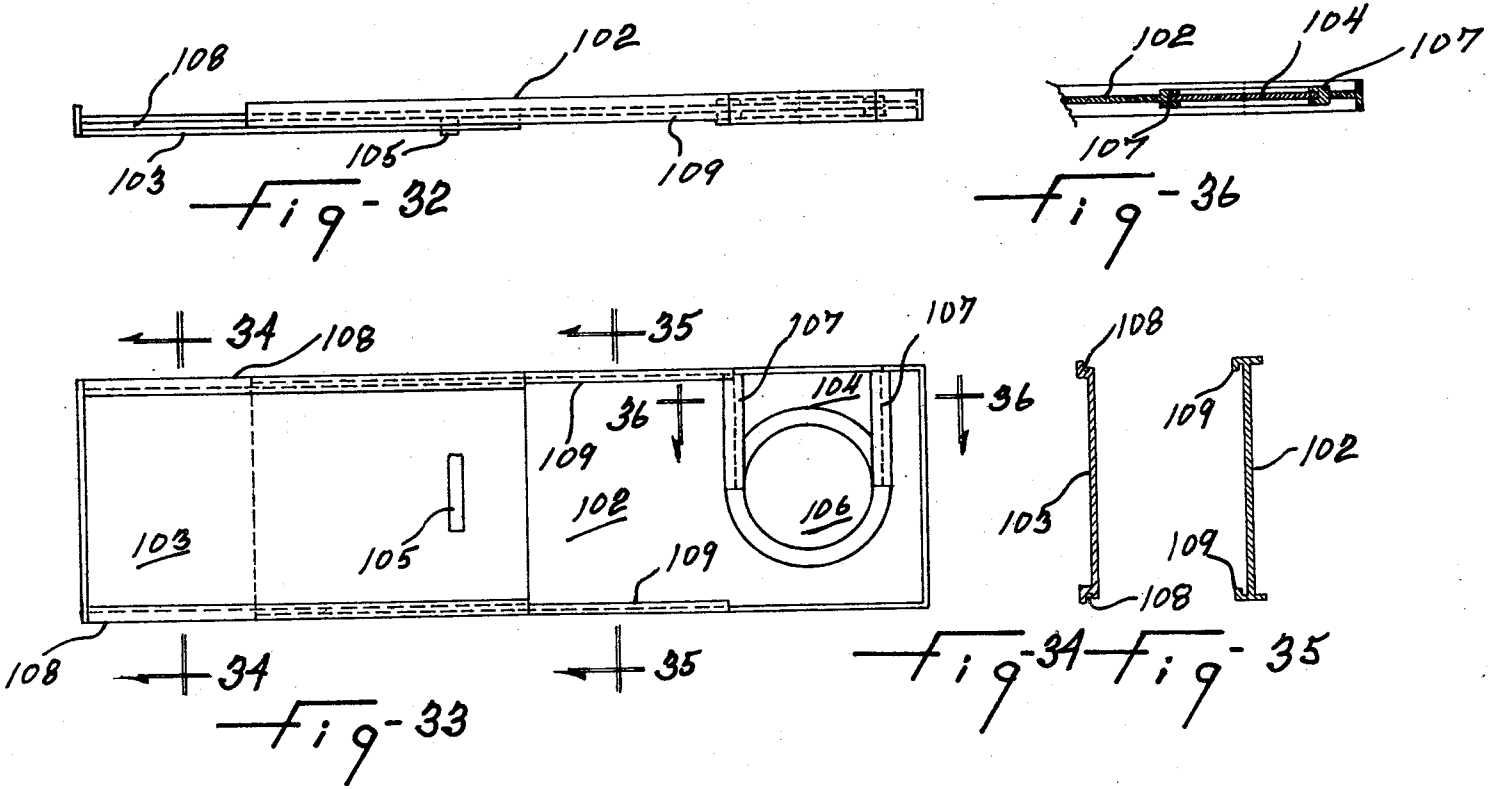

FIGS. 4 and 5 are cross-sections of the two sections of the assembly of FIG. 3 and taken along line 4—4 and 5—5, respectively;

FIG. 6 is a top plan view of the interior window insert plate assembly used for the interior window of a double window unit;

FIG. 7 is an elevation of the assembly of FIG. 6;

FIG. 8 is a cross-section taken along line 8—8 of FIG. 7;

FIG. 9 is a top plan view of a first embodiment of the exhaust outlet incorporating manually-operated closure means;

FIG. 10 is an end elevation of the exhaust outlet of FIG. 9;

FIG. 11 is a side elevation of the outlet of FIG. 9;

FIG. 12 is a longitudinal section of the outlet of FIG. 9 and taken along line 12—12 of FIG. 9;

FIG. 13 is a cross-section taken along line 13—13 of FIG. 11;

FIG. 14 is an elevation of the inside face of a second embodiment of an exhaust outlet in accordance with the invention and incorporating manually-operated closure means;

FIG. 15 is a side elevation of the outlet of FIG. 14;

FIG. 16 is a top plan view of the outlet of FIGS. 14 and 15;

FIG. 17 is a longitudinal section taken along line 17—17 of FIG. 16;

FIG. 18 is a top plan view of a third embodiment of the exhaust outlet in accordance with the invention and incorporating automatically-operated closure means;

FIG. 19 is an elevation from the inside face of the outlet of FIG. 18;

FIG. 20 is a side elevation of the outlet of FIG. 18;

FIG. 21 is a longitudinal section of the outlet of FIG. 18 and taken along line 21—21 of FIG. 18, the flap assembly being absent;

FIG. 22 is an exploded elevation of the flap assembly used in the outlet of FIG. 18;

FIG. 23 is an elevation, partially broken, of the assembly of the flexible hose with its coupling means at both ends thereof for connecting to the exhaust outlet and to the outlet of the laundry dryer;

FIG. 24 is an elevation of the inner end of the hose assembly of FIG. 23;

FIG. 25, shown on the sheet containing FIGS. 9 to 13, is a section of a cap for closing the interior end of the outlet of FIG. 9;

FIG. 26 is an end elevation of an elbow coupling in accordance with a second manner of connecting the flexible hose to the laundry dryer exhaust outlet;

FIG. 27 is a side elevation of the elbow of FIG. 26;

FIG. 28 is a partial section taken along the line 28—28 of FIG. 26;

FIG. 29 is an end elevation of another embodiment of an elbow coupling;

FIG. 30 is a side elevation of the elbow of FIG. 29;

FIG. 31 is an elevation of the inlet end of the flexible hose with coupling means to fit the elbow of FIG. 26 or of FIG. 29;

FIG. 32 is a top view of still another embodiment of the telescopic inner window insert plate assembly;

FIG. 33 is an elevation of the embodiment of FIG. 32;

FIGS. 34 and 35 are cross-sections taken along line 34—34 and 35÷35, respectively of FIG. 33; and FIG. 36 is a partial plan section taken along line 36—36 of FIG. 33.

In the drawings, like reference characters indicate like elements throughout.

Figure 1:
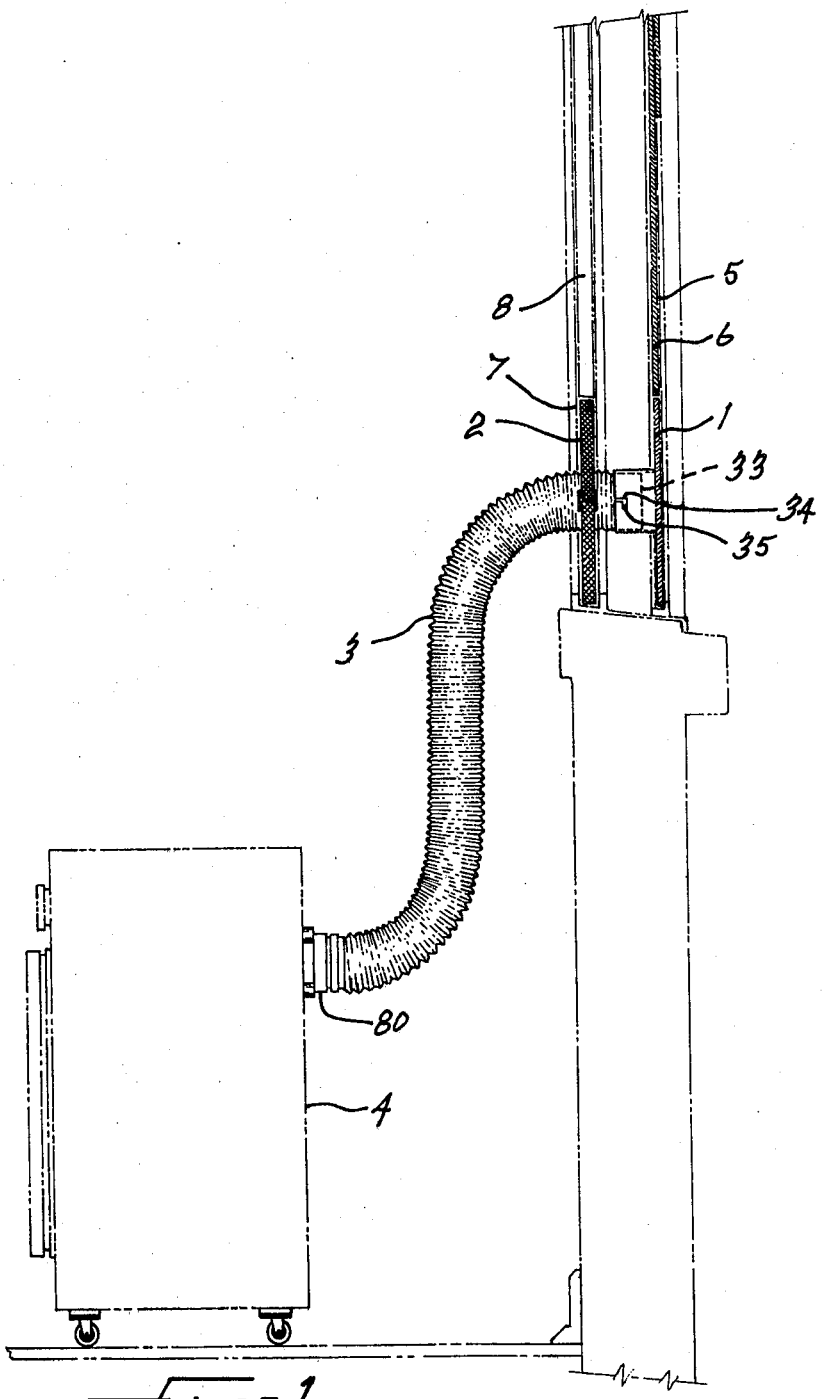
FIG. 1 is a vertical section of a double window unit showing the window insert plate assemblies in accordance with the invention inserted therein and showing in elevation a flexible hose connected to a laundry dryer, shown in dot and dash lines.

FIG. 1 shows the general assembly of the invention wherein a laundry dryer 4 has its hot and humid air exhaust connected by means of a removable coupling assembly 80 to a flexible hose 3, the other end of which, indicated at 33, is removably connected to an opening made in an outer window insert plate assembly 1 for the exhaust to the exterior of the building of the hot and humid air from the laundry dryer 4.

Exterior window plate assembly 1 is fitted within the side channels of a standard aluminum window frame 5 with the guillotine type lower window sash 6 in sealing contact with the top edge of plate assembly 1, so as to prevent entrance of outside air into the room where the laundry dryer is located.

In the case of a double window construction as shown, an inner window plate assembly 2 is fitted within the inner window opening in the side channels 7 thereof with the guillotine type lower window sash 8 in sealing contact with the top edge of assembly 2. This plate assembly 2 defines an opening for the passage of flexible hose 3.

FIG. 1 also shows how the outer nipple 33 defining the outer end of hose 3 is provided with an outwardly protruding pin 35 removably engageable with an L-shaped slot 34 of the sleeve of the exhaust opening of plate assembly 1. The construction of the latter is shown in FIGS. 2 to 5. It consists of two telescopically-engaged sections 9 and 10 to fit window openings of different widths. The two sections each consist of a rectangular flat plate, preferably made of transparent material, such as clear synthetic resin. Section 9 has inturned L-shaped guide rails 12 at the top and bottom longitudinal edges adapted to fit over the outturned longitudinally extending L-shaped guide rails 13, provided at the top and bottom longitudinal edges of section 10. Thus, the two sections 9 and 10 can slide relative to each other along their guide rails 12 and 13. The top outer corners of sections 9 and 10 are provided with an outwardly protruding metal pin 11, adapted to fit within a hole of the side channels of the aluminum window frame 5 to prevent removal of the plate assembly 1. Also, the two sections 9 and 10 can be locked in position within the window opening by means of a latch system, shown in FIG. 3, and comprising a latch lever 18 pivoted to ears 15 secured to section 10 and having a pawl 16 engageable with any of the teeth of rack 17 formed at the bottom of the guide rail 12 of section 10. A handle 14 protruding from the inside face of section 9 facilitates the extension movement of the plate assembly 1. Section 9 has a circular opening 29 serving as the exhaust outlet.

FIGS. 6 and 8 show the inner window plate assembly, which is also extendable to fit inner window openings of different widths. It has a generally rectangular shape and is composed of two rigid plate sections, namely: a lower plate section 19 and a top plate section 20 sealed together at their longitudinal junction by means of a sealing strip 21, of H-shaped cross-section, so as to provide flanges overlying the surfaces of the two sections 19 and 20 with an intervening web contacting the longitudinal edges of said sections.

Sections 19 and 20 are provided with registering semi-circular notches at their contacting edges to form the circular opening 22 for the passage of flexible hose 3 when the two sections 19 and 20 are assembled. The top edge of the upper section 20 and the lower edge of the lower section 19 are lined with sealing strips 26 to make sealing contact with the bottom edge of the window sash and the sill of the inner window opening, respectively.

The plate assembly 2 is extensible to fit inner window opening of different widths. For this purpose, telescopic top and bottom sections 24 and 25, respectively, have each a tongue 23 telescopically engaged in a groove at the corresponding end of upper and lower sections 20 and 19, respectively.

The outlet opening 29 of the outer window plate assembly 1, illustrated in FIGS. 2 and 3, is fitted with a closure means to close the outlet of the flexible hose 3, or the interior of the room when the laundry dryer is not used.

One embodiment of this means is illustrated in FIGS. 9 and 13 and FIG. 25. It comprises a circular sleeve 27 having an annular flange 30 at one end, adapted to be secured around opening 29 of the plate section 9 of the assembly of FIGS. 2 to 5 on the inside face of said section.

A tube 28, of a length equal to about twice the length of sleeve 27, is slidably fitted within sleeve 27. Tube 28 has an outwardly extending flange 41 at its inner end abutting against the inner end of sleeve 27 in the outwardly projecting position of the tube 28 to prevent further outward movement of the tube, as shown in FIG. 12. The outer end of tube 28 is closed by an end disc 32 having a marginal portion radially outwardly protruding from tube 28. In the retracted closed position of the tube 28, the peripheral portion of disc 32 abuts against the flange 30 of sleeve 27 fitting within the annular space defined around the tube 28 by the opening 29 of plate section 9.

The lower half-portion of the outer section of tube 28 is provided with a series of parallel longitudinally extending exhaust slots 36 which are closed to the outside air in the retracted position of tube 28 and which establish an outlet between the flexible hose 3 and the outside air in the protruding position of the tube 28.

Tube 28 can be locked either in retracted or in protruding position by means of a latch lever 31 pivoted at 43 intermediate its ends to a pair of ears upstanding from the top of sleeve 27. Latch lever 31 extends longitudinally of the sleeve and its outer end is urged upwardly by a coil spring 40 inserted between the top of the sleeve 27 and the underside of lever 31. The inner end of lever 31 carries a downwardly extending locking pin 37 adapted to engage anyone of two holes 39 made in tube 28 to lock the latter either in protruding position, as shown, or in retracted position with end disc 32 flat against flange 30 and flush with window plate section 9. To prevent rotation of tube 28 within sleeve 27, the top of tube 28 is provided with a longitudinally extending groove 38 ending at each stop hole 39 and in which pin 37 lies during slidable movement of tube 28. Cap 42 (see FIG. 25) is adapted to fit within the inner end of tube 28 to form an additional closure against outside cold air when the flexible hose 3 is not connected to tube 28. For coupling of the hose 3 to tube 28, the latter is provided with an L-shaped slot 34, at its inner end (see FIG. 11), adapted to receive an external locking pin 35 secured to nipple 33 (see FIG. 23). This nipple 23 fits within tube 28 at one end, while its other end fits within the outer end of hose 3 and is firmly connected thereto by means of strap 81.

FIGS. 14 to 16 show a second embodiment of the outside closure for the outer end of flexible hose 3. A rectangular frame 44 is secured around a rectangular opening of outer window plate assembly section 9 (see FIG. 17) to the inside face of section 9. The lower portion of frame 44 forms a bracket 60 which carries a latching device including a stem 58 rotatably mounted within bracket 60 and section 9, and having an actuating knob 59 on the inside of the window insert. A disc 57 is secured to stem 58 and has a cutout portion defining a straight edge 57' (see FIG. 14).

A transversely extending stop bar 16 is secured to the lower part of frame 44 (see FIG. 17) on the inside of disc 57. A rectangular closure plate 48 has its top transverse edge 47 rounded in cross-section, as shown in FIG. 17, and engaging a curved hinge groove 45 formed in frame 44.

Plate 48 is provided along its side edges with sector-shaped side plates 49, of triangular shape, with a curved lower 49' coaxial with the pivot axis at 47 and bearing against bar 46 to keep hinge edge 47 within hinge groove 45.

A plurality of transverse strips 53 interconnect the side plates 49 along the lower edge 49'.

A plate 50 is secured to the edges of side plates 49 and also to a curved top strip 50', so as to form a rigid assembly with side walls 49 and plate 48. Plate 50 has a central opening 54, of circular shape, to the edge of which is secured the flexible hose connecting tube 55 having at its inner edge the L-shaped slot 56 for removable connection of the outer of the flexible hose by means of its pin 35. In the open position of plate 48, as shown in FIG. 17, the humid and hot air from the dryer is discharged through the openings formed between the ribs 53. The air is downwardly directed.

Plate 48 can be closed by pulling on tube 55 to a closed position in which plate 48 fits within the opening of section 9 and is flush with the latter. In the closed position, the tube 55 is upwardly inclined. The plate 48 can be locked in open or closed position with the disc 57 engaging either the centrally located L-shaped flange 61 secured to plate 50 or L-shaped flange 62 secured to the lower end of plate 48. When the dryer is not in use, the plate 48 is closed and does not make any outside projection from the window.

FIGS. 18 to 21 show yet another embodiment of the closure means for the outer end of the flexible hose and mounted in the outer window plate assembly. The flexible hose connecting sleeve 63 of this embodiment is integrally formed with, or is secured to, section 9 of the outer window plate assembly 1, as shown in FIG. 21, and is provided at its inner end with the L-shaped bayonnet slot 64 (see FIG. 20) for receiving the pin 35 of the outer end of the hose 3.

A pair of ears 65, 66 are integrally formed with section 9 on the outside thereof and have hinged holes in vertical alignment to receive a hinge rod 74. A pair of semi-circular flaps 68, 69 are provided with perforated ears 70, 71, 72, 73 along their straight edges for the insertion of hinge rod 74. A coil spring 76 is wound around hinge rod 74, while its outer straight ends bear against the respective flaps 68, 69 to resiliently maintain the same in closed position against the marginal edge formed around the opening 75 in communication with sleeve 63.

The spring 76 is calculated to exert a pressure sufficient to close the flaps when no air pressure is in tube 63 but to allow opening of the flaps under the air pressure exerted by the ventilating system of the clothes dryer 4.

A top horizontal guide 77, of L-shaped cross-section, and a lower horizontal guide 78, also of L-shaped cross-section, are integrally formed on the outside of section 9 above and below the tube 63 and the ears 65 and 66, respectively.

A cowl 79 is slidably fitted within the guides 77 and 78 to extend opposite the discharge opening 75 of tube 63. This cowl is open at its two ends so that the hot and humid air will discharge sideways, being reflected by the inclined flaps 68 and 69. Cowl 79 can be easily removed whenever desired, so as, for instance, to facilitate access to the flap mechanism for maintenance purposes or when no protruding part is allowed on the outside of the window. Cowl 79 protects the opening against rain and snow.

As shown in FIGS. 23 and 24, the inner or dryer end of flexible hose 3 is inserted over a nipple 80 and secured thereto by a surrounding band 81. Nipple 80 is formed at its inner end with a collar having a plurality, for instance four, radially outwardly protruding equally angularly spaced ears 84, each carrying a permanent magnet 82 flush with the outside face of ear 84, so as to magnetically adhere to the steel wall portion surrounding the dryer exhaust outlet for the humid and hot air to make a communication with the hose 3.

When the hose 3 is detached from the laundry dryer, soft iron discs 85 are positioned against the permanent magnets 82 to prevent demagnetization of the magnets 82.

The coupling means of FIGS. 27, 28, and 31 is used with dryers having an interior exhaust tube, or when any other method of clamping the hose to the dryer is not possible from the outside. The coupling consists of an elbow fitting having an inner tubular part 86 provided with an interior groove 87 holding an O-ring 88 locked in position by the two stop rings 89 and 90. The part 86 is fitted over the interior exhaust tube of the dryer and the O-ring 88 forms an air-proof connection therewith. The elbow 91, 92 is held firmly. The outer end of elbow part 92 has a pin 95 protruding from the side face thereof engageable with the L-shaped slot 94 (see FIG. 31) formed at the end of the sleeve 93 fitted within the inner end of flexible hose 3 and held thereon by means of clamping collar 81.

FIGS. 29 and 30 show another type of elbow connection. The inner end of the elbow 91, 92 has a short neck 97 provided with a flange 96, in turn having a raised annular face 98 lined with a foam rubber ring 99 serving as a sealing gasket, which is applied against the periphery of the laundry dryer exhaust opening.

Flange 96 has a plurality of bayonnet type holes formed by a restricted portion 100 and a larger portion 101. These are equally spaced around flange 96. The flange 96 can thus be attached to the dryer by loosening the normal two Parker screws of the dryer exhaust grille ring and passing the screw heads through the larger hole portion 101 and then by turning the flange about 10 degrees to the right until screws enter the restricted hole portions 100. The screws are then tightened to hold the flange in place.

With this arrangement, due to the presence of a plurality of bayonnet holes 100, 101, the elbow can be oriented at 45 degree-intervals. The outer end of elbow 92 has a pin 95 to form a quick disconnect with the inner end of hose 3 by engaging L-shaped slot 94 (see FIG. 31).

The inner window plate assembly 2 of FIGS. 6 to 8 can be replaced, if desired, by the telescopic inner window plate assembly (shown in FIGS. 32 to 35) and preferably made of clear plastic material. This assembly is similar to the outer window plate assembly 1, illustrated in FIGS. 2 to 5 inclusive. It comprises telescopically-engaged rectangular plate sections 102 and 103 to fit window openings of different widths. Section 102 has inturned guide rails 109 at its top and bottom longitudinal edges slidably engaging outwardly directed guide rails 108 at the top and bottom longitudinal edges of section 103. The latter has a handle 105 to facilitate extension and retraction of the plate assembly.

Section 102 has a notch 106 through which extends the flexible hose 3. This notch 106 has a rounded bottom end and opens in full diameter at the top edge of section 102, and once the hose has been inserted in notch 106, a plate 104 is slidably inserted within vertical guide grooves 107 of section 102. Plate 104 has a semi-circular inner edge completing the circular opening in notch 106 through which the hose 3 extends.

All the window insert plate assemblies and window opening closure means in accordance with the invention are preferably of clear plastic material, so as not to diminish the light entering the room in which the dryer is located and also for esthetic reasons not to disfigure the window as seen from the outside.

The window insert plate assemblies of the invention can also fit windows in which the window sashes are horizontally slidable.

The window opening closure means of FIGS. 9 to 13 and of FIG. 25, and of FIGS. 14 to 17 can be directly installed in an opening cut directly in the glass pane of a window sash of the pivotable type.

The exhaust system can be used in association with other appliances requiring outside venting, such as a kitchen hood.

What is claim is:

1. An air exhaust system for a laundry dryer located in a room having a window including a window frame and a window sash slidable therein, and having an air exhaust outlet, comprising a window insert plate assembly removably inserted within said window frame and with said window sash contacting an edge of said window insert plate assembly, said window insert plate assembly including telescopically-engaged rectangular plate sections to fit window frames of different widths, one of said plate sections having an aperture, a unitary box-like closure means movably mounted within said aperture for movement between an aperture closing position and an aperture opening position, said box-like closure means including an outside plate, a side wall having a venting opening adjacent said outside plate and a nipple connected to said side wall and remote from said outside plate inwardly of the latter and communicating with the interior of said box-like closure means, said side wall and its venting opening being disposed inwardly of said one plate section and said outside plate closing said aperture and flush with said one plate section in the aperture closing position of said box-like closure means, said side wall and outside plate protruding outwardly from said one plate section in the aperture opening position of said box-like closure means with said venting opening being located completely outside of said one plate section, and further including a flexible venting hose having detachable connecting means at both ends for detachably connecting one end of said hose to said nipple and the other end of said hose to the exhaust outlet of said laundry dryer, said box-like closure means preventing air circulation between said room and the outside, in both positions of said box-like closure means when said hose is connected to said nipple and to said laundry dryer.

2. An air exhaust system as claimed in claim 1, wherein said aperture is of rectangular or square shape and further including a frame member secured to said one plate section and co-extensive with the periphery of said aperture, said frame member having a hinge groove along its top side, said outside plate having a rounded top edge hingedly inserted within said hinge groove, said side wall consisting of sector-shaped side plates secured to the side edges of said outer plate, said box-like closure means further including an inner plate secured to the inner longitudinal edges of said side plates, the assembly of said side plates, outer plate and inner plate forming a downwardly flaring funnel, the inner plate having a circular opening, said nipple secured to said inner plate around said lastnamed opening, said sector-shaped side plates having a curved lower edge co-axial with the hinge axis of said funnel and slidably bearing against the transverse bottom edge of said frame member to keep the top edge of said outer plate in hinged relationship with said hinge groove.

3. An air exhaust system as claimed in claim 1, wherein one of said plate sections has inturned guide rails along its top and bottom longitudinal edges slidably engaging outwardly directed guide rails formed along the top and bottom edges of the other of said plate sections, a pivotally mounted latch lever carried by one of said plate sections and engageable with rack teeth formed longitudinally of the other of said plate sections to removably secure the two plate sections in adjustably extended position.

4. An air exhaust system as claimed in claim 2, wherein the curved lower edges of said sector-shaped side plates are interconnected by spaced ribs forming a grill for the discharge end of said funnel.

5. An air exhaust system as claimed in claim 2, further including an interiorly accessible latching means to selectively latch the funnel in closed and open position, respectively.

* * * * *